US005208630A

United States Patent [19]

Goodbrand et al.

[11] Patent Number: 5,208,630

[45] Date of Patent: May 4, 1993

[54] PROCESS FOR THE AUTHENTICATION OF DOCUMENTS UTILIZING ENCAPSULATED TONERS

[75] Inventors: H. Bruce Goodbrand, Hamilton; James M. Duff; Raymond W. Wong, both of Mississauga, all of Canada

[73] Assignee: Xerox Corporation, Stamford, Conn.

[21] Appl. No.: 787,470

[22] Filed: Nov. 4, 1991

[51] Int. Cl.[5] ..... G03G 21/00

[52] U.S. Cl. ..... 355/201; 283/73; 355/133; 430/137

[58] Field of Search ..... 355/201, 77, 133, 27; 430/109, 137, 138, 616; 380/54, 55; 283/73, 902

[56] References Cited

U.S. PATENT DOCUMENTS

| | | | |
|---|---|---|---|
| 3,829,661 | 8/1974 | Silverman et al. | 283/73 X |
| 3,898,171 | 8/1975 | Westdale | 252/62.1 P |
| 4,308,327 | 12/1981 | Bird et al. | 430/15 |
| 4,442,194 | 4/1984 | Mikami | 430/137 |
| 4,543,308 | 9/1985 | Schumann et al. | 430/21 |
| 4,586,811 | 5/1986 | Kubo et al. | 355/201 |
| 4,678,322 | 7/1987 | Finkel et al. | 355/201 X |
| 4,699,866 | 10/1987 | Naoi et al. | 430/138 |
| 4,728,984 | 3/1988 | Daniele | 355/201 X |
| 4,739,377 | 4/1988 | Allen | 355/201 X |
| 4,777,510 | 10/1988 | Russel | 355/328 |
| 4,916,042 | 4/1990 | Sakojiri et al. | 430/138 |
| 5,077,167 | 12/1991 | Ong et al. | 430/137 X |

FOREIGN PATENT DOCUMENTS

| | | | |
|---|---|---|---|
| 2536885 | 6/1984 | France | 283/73 |

OTHER PUBLICATIONS

Xerox Disclosure Journal, vol. 13, No. 4, Jul./Aug. 1988, "Copy Sheet Size and Weight Sensing", Norman D. Robinson, Jr.

IBM *Technical Disclosure Bulletin*, "Copier Security System", vol. 18 No. 3, (Aug. 1975).

*Primary Examiner*—A. T. Grimley
*Assistant Examiner*—Sandra L. Brasé
*Attorney, Agent, or Firm*—E. O. Palazzo

[57] ABSTRACT

A process for the authentication of documents which comprises generating developed documents in an electophotographic apparatus, or in a laser printer, with an encapsulated toner comprised of a core comprised of polymer, pigment, and an infrared absorbing component, and thereover a polymeric shell; and subjecting the document to an infrared reader whereby the near infrared absorbing component is detected spectroscopically.

3 Claims, No Drawings

PROCESS FOR THE AUTHENTICATION OF DOCUMENTS UTILIZING ENCAPSULATED TONERS

BACKGROUND OF THE INVENTION

The present invention is directed to processes, and more specifically to processes wherein a component of the toner selected for the development of images can be detectable, especially by a reader that is sensitive to infrared light. In one embodiment, the process of the present invention comprises the generation of documents, such as tickets, like tickets to sports activities, with an encapsulated toner that contains an infrared absorbing pigment, or taggant, such as a metal free phthalocyanine, a metal phthalocyanine, vanadyl phthalocyanine, and the like. The aforementioned encapsulated toner usually contains the absorbing pigment in the core thereof. An example of an encapsulated toner that may be selected is comprised of a core comprised of a polymer, a pigment, a near infrared absorbing component, and thereover a polymeric shell preferably prepared by interfacial polymerization.

Illustrated in copending patent application U.S. Ser. No. 636,264 (D/89191), the disclosure of which is totally incorporated herein by reference, is a process for controlling a reproduction system, comprising the steps of: scanning an image to detect at least one taggant in at least one marking material forming said image; and issuing instructions to said reproduction system, wherein said instructions cause said reproduction system to take an action selected from the group consisting of. (a) prohibiting reproduction of those portions of said image formed by said marking material containing at least one predetermined detected taggant, and reproducing of all other portions of said image; (b) prohibiting reproduction of any part of said image upon detecting of at least one predetermined taggant; (c) reproducing only those portions of said image formed by said marking material containing at least one predetermined taggant; (d) reproducing portions of said image formed by said marking material containing at least one predetermined taggant in a different manner from that in which said system reproduces portions of said image formed by said marking material not containing said at least one predetermined taggant; and (e) identifying a source of said image on the basis of detection of at least one predetermined taggant. It is indicated in this patent application that taggants may also provide security for important documents. The system of the copending application is capable of identifying documents (as well as marking materials) containing taggants which may be present in the toner or ink used to create an image on the document. Thus, copies made using such toner or ink doped with taggant can be readily identified. This can permit subsequent identification of the source of an image, generally by type of machine (for example for statistical data gathering) or more specifically by facility where a copy was made or even by the specific machine unit in which a copy was made (like for document tracking). Further, according to the copending application documents or portions thereof may also be made that are incapable of being copied by using tagged marking materials for at least the portion of the document for which protection is desired. The identification of a predetermined taggant may signal the system to prevent scanning, storing or developing operations of the whole document or areas where the particular taggant is present.

Illustrated in U.S. Pat. No. 5,082,757 (D/90072), the disclosure of which is totally incorporated herein by reference, are encapsulated toners with a core comprised of a polymer binder, pigment or dye, and thereover a hydroxylated polyurethane shell, and which shell has the ability to effectively contain the core binder and prevent its loss through diffusion and leaching process. Specifically, in one embodiment there is provided in accordance with the copending application encapsulated toners comprised of a core containing a polymer binder, pigment or dye particles, and thereover a hydroxylated polyurethane shell derived from the polycondensation of a polyisocyanate and a water-soluble carbohydrate such as a monosaccharide, a disaccharide or the derivatives thereof with the polycondensation being accomplished by the known interfacial polymerization methods. Another specific embodiment of the copending application is directed to pressure fixable encapsulated toners comprised of a core of polymer binder, magnetic pigment, color pigment, dye or mixtures thereof, and a hydroxylated polyurethane shell, and coated thereover with a layer of conductive components, such as carbon black. There is indicated in this copending patent application that encapsulated cold pressure fixable toner compositions are known. Cold pressure fixable toners have a number of advantages in comparison to toners that are fused by heat, primarily relating to the utilization of less energy and enabling the use of heatless instant-on imaging apparatus, since the toner compositions selected can be fixed without application of heat.

In a patentability search report for the aforementioned copending patent application, the following prior art, all United States patents, were recited: U.S. Pat. No. 4,442,194 which discloses encapsulated toners with shells comprised of substances (A) and (B), see column 3 for example, wherein (A) can be an isocyanate and (B) can be an active hydrogen containing compound, see column 4, such as polyols, water, sorbitol, and the like, see column 5; a similar teaching is present in U.S. Pat. No. 4,699,866; 3,898,171, which discloses an electroscopic powder formulated with sucrose benzoate and a thermoplastic resin, see for example column 2; and U.S. Pat. No. 4,465,755 and 4,592,957 as being of possible background interest.

The following U.S. patents are also mentioned: U.S. Pat. No. 3,967,962 which discloses a toner composition comprising a finely divided mixture comprising a colorant and a polymeric material which is a block or graft copolymer, including apparently copolymers of polyurethane and a polyether (column 6), reference for example the Abstract of the Disclosure, and also note the disclosure in columns 2 and 3, 6 and 7, particularly lines 13 and 35; U.S. Pat. No. 4,565,764 which discloses a microcapsule toner with a colored core material coated successively with a first resin wall and a second resin wall, reference for example the Abstract of the Disclosure and also note columns 2 to 7, and particularly column 7, beginning at line 31, wherein the first wall may comprise polyvinyl alcohol resins known in the art including polyurethanes, polyureas, and the like; U.S. Pat. No. 4,626,490 contains a similar teaching as the '764 patent and more specifically discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; U.S. Pat. Nos. 4,442,194; 4,465,755, and U.S. Patents of background interest including U.S. Pat. Nos. 4,520,091; 4,590,142; 4,610,945; 4,642,281; 4,740,443 and 4,803,144. The disclosures of each of the aforementioned U.S. patents are totally incorporated herein by reference.

SUMMARY OF THE INVENTION

It is an object of the present invention to provide processes for the generation of images on a number of documents.

It is another object of the present invention to provide encapsulated toners with taggants.

It is yet another object of the present invention to provide security documents, such as tickets, identification badges, passes, negotiable securities, and the like with encapsulated toners containing a component sensitive to or near infrared light, that is with a wavelength of from between about 650 to about 950 nanometers.

It is still another object of the present invention to provide processes that prevent the duplication of documents, including security documents, like tickets, cerdit cards, and the like by employing encapsulated toners with core taggants, and wherein one of the core components is detectable by a sensor that detects wavelengths invisible to the human eye, such as an infrared detector.

Another object of the present invention is to provide processes for determining the authenticity of documents, such as tickets, credit cards, and the like by employing for the generation thereof encapsulated toners with core taggants, and wherein one of the core components is detectable by a sensor that detects wavelengths invisible to the human eye, such as an infrared detector.

It is yet another object of the present invention to provide encapsulated toner compositions that are visible to the human eye under normal viewing conditions and are also readable by a sensor that detects wavelengths invisible to the human eye, such as an infrared detector under special viewing conditions such as illumination of the image with radiation at a wavelength that the detector is capable of sensing.

It is still another object of the present invention to provide encapsulated toner compositions that can provide a means for placing coded information on a document.

These and other objects of the present invention can be achieved by providing processes for the authentication of documents. In one embodiment of the present invention, there are provided processes for the authentication of documents, such as tickets, credit cards, and the like by generating these documents with an encapsulated toner containing an infrared sensitive component, which compositions are detectable when exposed to radiation outside the visible wavelength range, and more specifically a wavelength of from between about 650 to 950 nanometers. Also, there are provided with the present invention infrared or near encapsulated toner compositions.

In one embodiment, the present invention is directed to a process for the authentication of documents which comprises generating developed documents in an electrophotographic apparatus, or in a laser printer with an encapsulated toner comprised of a core comprised of a polymer, a pigment, or pigments, and an infrared absorbing component, and thereover a polymeric shell; and subsequently subjecting the document to an red reader whereby the infrared absorbing component is detected spectroscopically. The developed documents can be formed from latent electrostatic images in various known imaging apparatuses, such as the Xerox Corporation 5090 TM, and thereafter developed with the encapsulated toners illustrated herein, followed by fusing.

In one embodiment, the process of the present invention comprises creating a document toned completely or only in specific areas with the infrared absorbing toner illustrated herein. The authenticity of this document may then be confirmed by analyzing the reflected light from the document with a scanner such as a known diode array detector. By comparing the intensity of light reflected from the surface of the printed document at the wavelength corresponding to absorption maximum of the near infrared absorbing component with either background reflection or reflection from toned areas not containing the taggent, the presence of the infrared active material may be confirmed and the authenticity of the document affirmed.

The encapsulated toners of the present invention can be comprised of a core comprised of a polymer, pigment, including colored pigments such as red, and a component sensitive to near infrared light, like vanadyl phthalocyanine, and a polymeric shell.

Illustrative examples of core monomers, which are subsequently polymerized after microcapsule shell formation, and are present in an effective amount of from, for example, about 15 to about 90 weight percent, and preferably from about 20 to about 50 weight percent, include acrylates, methacrylates, olefins including styrene and its derivatives, and the like. Specific examples of core monomers include methyl acrylate, methyl methacrylate, ethyl acrylate, ethyl methacrylate, propyl acrylate, propyl methacrylate, buty acrylate, buty methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known core pigments that can be selected include magnetites, such as Mobay magnetites MO8029 TM, MO8060 TM; Columbian MAPICO BLACKS TM and surface treated magnetites; Pfizer magnetites CB4799 TM, CB5300 TM, CB5600 TM, MCX636 TM; Bayer magnetites BAYFERROX 8600 TM, 8610 TM; Northern Pigments magnetites, NP-604 TM, NP-608; TM Magnox magnetites TMB-100 TM or TMB-104 TM; and other similar black pigments, including mixtures of these pigments with other colored pigments illustrated herein. As colored core pigments there can be selected RED LAKE C TM, HELIOGEN BLUE L6900 TM, D6840 TM, D7080 TM, D7020 TM, Pylam Oil Blue and Pylam Oil Yellow, Pigment Blue 1 available from Paul Uhlich & Company, Inc., Pigment Violet 1, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAPERM YELLOW FGL TM, HOSTAPERM PINK E TM available from Hoechst, Cinquasia Magenta available from E.I. DuPont de Nemours & Company, and the like. Primary colored pigments, that is cyan, magenta, or yellow pigments, can be selected for the toner compositions of the present invention. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4' chloro-2,5-dimethoxy acetoacetanilide, and Permanent Yellow FGL. The aforementioned pigments can be incorporated into the microencapsulated toner compositions of the present invention in various effective amounts. In one embodiment, the pigment particles are present in the toner composition in an amount of from about 2 percent by weight to about 65 percent by weight calculated on the weight of the dry toner.

Shell examples include polyesters, polyureas, polyurethanes, polyamides, and the like.

Surface additives that can be selected to, for example, improve the surface characteristics of the toners in embodiments of the present invention include, for example, metal salts, metal salts of fatty acids, colloidal silicas, mixtures thereof and the like, which additives are usually present in an amount of from about 0.1 to about 5 weight percent, reference U.S. Pat. Nos. 3,590,000; 3,720,617; 3,655,374 and 3,983,045, the disclosures of which are totally incorporated herein by reference. Preferred surface additives include zinc stearate and AEROSIL R972 ®.

Examples of infrared sensitive core components selected in embodiments of the present invention, include metal phthalocyanines, vanadyl phthalocyanine, dihydroxygermanium phthalocyanines like copper phthalocyanine, metal free phthalocyanines, such as x-metal free phthalocyanine, present in various effective amounts of, for example, from between about 0.5 and 10, and preferably from between about 1 and about 8 weight percent of the toner.

Known polymeric shells as the encapsulating component can be selected, which polymers are preferably formed by interfacial polymerization. Examples of shell polymers include the reaction product of an amine and a diisocyanate, such as DESMODUR W ® [bis-[4-isocyanatocyclohexyl]methane] and DYTEK A ® (1,5-diamino-2-methylpentane), TMXDI ® (tetramethylxylyldiisocyanate) and DYTEK A ®, or a mixture of DESMODUR W ® (50.3 weight percent), DYTEK A ® (11.2 weight percent) and JEFFAMINE 400 ® (38.5 weight percent) present in the amount of about 5 to about 30 weight percent, and preferably in n amount of from about 10 to about 20 weight percent of the toner.

The aforementioned toner compositions of the present invention can be prepared by a number of different processes as indicated herein and known processes, including a chemical microencapsulation process which involves a shell forming interfacial polycondensation and an in situ core binder forming free radical polymerization. The process is comprised, for example, of first thoroughly mixing or blending a mixture of core binder monomer or monomers, a free radical initiator, a colorant or mixture of colorants including magnetites, an infrared absorbing component, and a polyisocyanate or polyisocyanates; dispersing the aforementioned well blended mixture by high shear blending into stabilized microdroplets of specific droplet size and size distribution in an aqueous medium containing a suitable stabilizer or emulsifying agents, and wherein the volume average microdroplet diameter can be desirably adjusted to be from about 5 microns to about 30 microns with the volume average droplet size dispersity being less than 1.4 as inferred from the Coulter Counter measurements of the microcapsule particles after encapsulation; subsequently subjecting the aforementioned dispersion to the shell forming interfacial polycondensation by adding an isocyanate, a polyol or polyols selected preferably from low molecular weight carbohydrates such as monosaccharides or disaccharides; and thereafter initiating the core binder forming free radical polymerization within the newly formed microcapsules with heat. The shell forming interfacial polycondensation is generally executed at ambient temperature, about 25° C., but elevated temperatures may also be employed depending on the nature and functionality of the shell components used. For the core binder forming free radical polymerization, it is generally accomplished at temperatures from ambient temperature to about 100° C., and preferably from ambient temperature to about 85° C. In addition, more than one initiator may be utilized to enhance the polymerization conversion, and to generate the desired molecular weight and molecular weight distribution.

Illustrative examples of free radical initiators that can be selected include azo compounds such as 2-2'-azodimethylvaleronitrile, 2-2'-azoisobutyronitrile, azobiscyclohexanenitrile, 2-methylbutyronitrile, or mixtures thereof, and other similar known compounds with the quantity of initiators being, for example, from about 0.5 percent to about 10 percent by weight of core monomers. Stabilizers selected include water soluble polymeric surfactants such as poly(vinyl alcohols), partially hydrolyzed poly(vinyl alcohols), hydroxypropyl cellulose, and methyl cellulose with a stabilizer to water ratio of from about 0.05 to about 0.75 for example.

The encapsulated toner compositions selected for the present invention in embodiments are mechanically stable and possess acceptable shelf life stability. For example, they do not suffer from premature rupture, and are nonblocking and nonagglomerating. The shell materials of the present invention are robust and display a low degree of shell permeability to the core components, and in particular to the core binder. In addition, the toner compositions of the present invention enable the achievement of a relatively high initial fix of, for example, 50 percent, thereby permitting the toner compositions to be utilized in duplex printing and imaging systems without undue complications such as image offset or image smear. Furthermore, the toner compositions of the present invention also offer in some embodiments very high final image fix of 85 to 95 percent, thereby ensuring excellent image permanence characteristics for high quality printing.

Also, the toner compositions can be rendered conductive with, for example, a volume resistivity value of from about $10^3$ ohm-cm to about $10^8$ ohm-cm by adding to the toner surface thereof components such as carbon blacks, graphite, and other conductive organometallic components. The aforementioned conductive toner compositions of the present invention are particularly useful for the inductive development of electrostatic images. More specifically, in accordance with the present invention, there is provided a method for developing electrostatic images which comprises forming latent electrostatic images on a hard dielectric surface of an image cylinder by depositing ions from a corona source; developing the images with the single component magnetic toner composition illustrated herein; followed by simultaneous transferring and fixing by pressure onto paper with a toner transfer efficiency greater than 95 percent, and in many cases over 99 percent. The transfix pressure utilized for image fixing is generally less than 1,000 psi to about 4,000 psi, but preferably the transfix pressure is set at 2,000 psi to eliminate or alleviate the paper calendering and high image gloss problems. Examples of pressure fixing processes and systems that can be selected include those commercially available from Delphax, Inc., Hitachi Corporation, and Cybernet, Inc.

The following Examples are being submitted to further define various species of the present invention. These Examples are intended to be illustrative only and are not intended to limit the scope of the present invention.

EXAMPLE I

A 7.4 micron (volume average diameter) encapsulated toner with a polyurea shell derived from DESMODUR W® (bis-[4-isocyanatocyclohexyl]methane) and DYTEK A® (1,5-diamino-2-methylpentane), and a copolymerized core of styrene and n-lauryl methacrylate was prepared as follows:

The pigments vanadyl phthalocyanine (21.85 grams) and RED LAKE C™ (9.36 grams) were ground in an attritor for 5 hours with a vehicle of n-lauryl methacrylate (126.4 grams) and styrene (154.6 grams). To the pigment containing monomer was then added the shell-forming diisocyanate DESMODUR W® (36.57 grams) and the initiators VAZO 52® [2,2'-azobis(2,4-dimethylvaleronitrile)] (3.15 grams) and VAZO 67® [2,2'-azobis(2-methylbutyronitrile)] (3.15 grams). The monomer mixture was shaken on a wrist action shaker for one hour to insure complete dissolution of the initiators. A 265 gram portion of this organic mixture was then dispersed in 880 grams of a continous phase comprising an aqueous solution of 1 percent by weight of TYLOSE® and 0.2 percent by weight of sodium dodecyl sulfate by employing a Brinkmann Polytron high speed disperser operating at 10,000 rpm for 90 seconds. The resulting dispersion was then transferred to a 2 liter resin kettle immersed in an oil bath. To the dispersion was added slowly over 30 minutes by syringe pump DYTEK A® (16.43 grams) dissolved in 30 grams of deionized water. This dispersion was allowed to stir at room temperature for 1 hour to allow shell formation, and thereafter, the kettle was heated to 85° C. over a period of 1.5 hours and polymerization was continued at this temperature for 6 hours before cooling down to room temperature, about 25° C. The encapsulated toner particles were then transferred to centrifuge jars and spun down on a Cryofuge 6,000 centrifuge operating at 3,000 rpm for 15 minutes.

The toner particles were resuspended in water and again spun down. This washing process was repeated four times and the particles then isolated by freeze drying on a conventional freeze drying apparatus. The collected dry encapsulated particles (210 grams) showed a volume average particle diameter, as measured on a 256 channel Coulter Counter, of 7.4 microns with a volume average particle dispersity of 1.61.

Flowability of the encapsulated toner obtained was improved by the dry blending thereof with 0.75 weight percent of AEROSIL R812® on a Labmaster blender with the processing bar rotating at 3,000 rpm for 15 seconds, followed by a rest period of 30 seconds and the cycle time repeated off and on for a total processing time of 20 minutes, and complete incorporation of the flow agent on the surface of the toner was accomplished.

EXAMPLE II

A conventionally sized 14 micron (volume average diameter) encapsulated toner with a 20 percent by weight DESMODUR W® [bis-{4,4'-diisocyanato)cyclohexyl]methane) and DYTEK A® [1,5-diamino-2-methylpentane] shell and a copolymerized styrene-n-lauryl methacrylate core was prepared as follows:

The pigments vanadyl phthalocyanine (15.6 grams) and N,N'-bis(acetamido)perylenediimide (15.6 grams) were ground in an attritor for 5 hours with a monomer vehicle consisting of n-lauryl methacrylate (126.4 grams) and styrene (154.6 grams). To the pigment containing monomer was then added the shell-forming monomer DESMODUR W® (22.08 grams) and the initiators VAZO 52® (1.9 grams), VAZO 67® (1.9 grams), and VAZO 88® (1.9 grams). This monomer mixture was shaken on a wrist action shaker for one hour to insure complete dissolution of the initiators. A 160 gram portion of this organic mixture was then dispersed in a continuous phase comprised of 531 grams of a 1 percent by weight aqueous solution of TYLOSE® containing 0.04 percent by weight of sodium dodecyl sulfate by employing a Brinkmann high speed disperser operating at 10,000 rpm over a period of 90 seconds. The resulting dispersion was then transferred to a 2 liter resin kettle immersed in an oil bath. To the dispersion was then added over 30 minutes by syringe pump DYTEK A® (5.65 grams) dissolved in 10 milliliters of deionized water. This dispersion was allowed to stir at room temperature for 1 hour to allow shell formation, and thereafter, was heated to 85° C. over a period of 1.5 hours and polymerization was continued for 5 hours at this temperature after which it was cooled to room temperature, about 25° C. The encapsulated particles were then transferred to centrifuge jars and spun down on a Cryofuge 6000 centrifuge operating at 3,000 rpm for 15 minutes. The particles were resuspended in deionized water and the process was repeated. A total of 4 washes were carried out. The particles were then freeze dried on a conventional freeze drying apparatus to yield the dry toner which exhibited a volume average diameter of 14.1 microns with a volume average particle dispersity of 1.7 as measured on a 256 channel Coulter Counter.

To the prepared encapsulated toner was added a flow and by dry blending with 0.75 weight percent of AEROSIL R812® on a Labmaster blender with the processing bar set at 3,000 rpm and cycle on for 15 seconds, and cycle off for 30 seconds for a total processing time of 20 minutes.

Xerographic developed images with the above prepared toners of Examples I and II, 3 weight percent, present with 97 weight percent of carrier particles comprised of 100 microns of HOEGANOES TM powder coated with 0.14 percent of KYNAR 301® were created by cascade development on Xerox Corporation 4020 TM transparencies in a Xerox Corporation 4020 TM device. The images were then fixed by a hot roll fuser operating at 150° C. with a dwell time of 300 milliseconds. Absorption spectra of the fused images were then recorded for images developed with the toners from the transparencies on a Shimadzu spectrophotometer operating in the spectral range of 350 to 1,100 nanometers. The strong 830 nanometers infrared transition of the vanadyl phthalocyanine incorporated in both toners was clearly detected spectroscopically, well separated from the other toner absorption bands.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the authentication of documents which comprises generating developed documents in an electrophotographic apparatus, or in a laser printer, with an encapsulated toner comprised of a core comprised of polymer, pigment, and an infrared absorbing component, and thereover a polymeric shell; and subjecting said documents to an infrared reader whereby said infrared absorbing component is detected spectroscopically.

2. A process for avoiding the copy of documents which comprises generating said documents entirely or in selected areas with an encapsulated toner comprised of a core comprised of polymer, pigment, and an infrared absorbing component, and thereover a polymeric shell, and thereafter scanning the reflected light from said documents whereby there is detected spectroscopically said infrared absorbing component.

3. A process for determining the authentication of documents comprised of a supporting substrate and developed images thereover which comprises generating documents in an electrophotographic apparatus, wherein latent images are initially formed followed by development with an encapsulated toner comprised of a core comprised of a polymer, pigment particles, and an infrared absorbing component, and thereover a polymeric shell; transferring the images developed to a supporting substrate, and fusing the images thereto; and subjecting said documents comprised of said supporting substrate and developed images thereover formed to an infrared reader whereby said infrared absorbing component is detected spectroscopically.

* * * * *